United States Patent [19]

Elson

[11] 4,182,085

[45] Jan. 8, 1980

[54] METHOD AND STRUCTURE FOR INSULATING A WALL OR CEILING

[76] Inventor: Jesse M. Elson, 138 E. Washington Ave., Pearl River, N.Y. 10965

[21] Appl. No.: 906,781

[22] Filed: May 17, 1978

[51] Int. Cl.[2] ..... E04G 9/10

[52] U.S. Cl. ..... 52/2; 156/71; 156/145; 52/741; 52/406

[58] Field of Search ..... 156/145, 71; 52/2, 741, 52/743, 406, 407, 742; 9/316, 318, 323, 314

[56] References Cited

U.S. PATENT DOCUMENTS

| | | | |
|---|---|---|---|
| 1,970,803 | 8/1934 | Johnson | 156/145 |
| 2,028,253 | 1/1936 | Spafford | 52/406 |
| 2,202,225 | 5/1940 | Murray et al. | 9/316 |
| 3,012,923 | 12/1961 | Slayter | 156/164 |
| 3,121,649 | 2/1964 | Oliver | 156/71 |
| 3,510,895 | 5/1970 | Wynne | 9/323 |
| 4,035,857 | 7/1977 | Briley | 9/314 |

FOREIGN PATENT DOCUMENTS

| | | | |
|---|---|---|---|
| 194139 | 1/1908 | Fed. Rep. of Germany | 5/365 |

*Primary Examiner*—James L. Ridgill, Jr.

*Attorney, Agent, or Firm*—James A. Wong

[57] ABSTRACT

Method and structure for insulating a building wall, ceiling, or like member supported by studs or rafters along various areas thereof, comprising the use of an inflatable envelope of gas impervious material wherein the inflatable envelope includes at least two main wall portions;

a first heat transfer barrier member substantially fully covering and secured to one of the main wall portions externally of the inflatable envelope;

a second heat transfer barrier member substantially fully covering and secured to the other of the main wall portions externally of the inflatable envelope;

a member separating the two main wall portions situated within the interior of the inflatable envelope and disposed between two main wall portions; and a valve for facilitating entry of an inflating medium into the inflatable envelope and retaining an inflating medium within the inflatable envelope; the method including installing the structure, securing it in place, and inflating the envelope.

10 Claims, 5 Drawing Figures

METHOD AND STRUCTURE FOR INSULATING A WALL OR CEILING

BACKGROUND OF THE INVENTION

1. Field of the Invention

The field of the invention is believed to be best exemplified by art which may be found in Class 52, Subclasses 2, 173, 406 and 407; Class 62, Digest 13; and Class 428, Subclasses 69 and 178 in the U.S. Patent Office.

2. Description of the Prior Art

This invention was developed as a result of applicant's personal awareness of the need for a new and improved method and structure of insulating the walls or ceiling of a building in order to reduce energy consumption. The invention was developed without actual knowledge of the prior art in the U.S. Patent Office. This application has, however, been prepared subsequently with knowledge of the following prior art U.S. Pat. Nos:

2,028,253—SPAFFORD
2,779,066—GAUGLER et al
2,817,124—DYBVIG
2,939,811—DILLON
3,004,877—SIMMS et al
3,264,165—STICKEL
3,729,879—FRANKLIN
3,850,714—ADORJAN

Of the art listed above Spafford is of interest in that it discloses the use of two layers of insulation 20 and 21 (FIG. 2) sealed into an envelope. An air space 31 is provided between the layers of insulation and a corrugated board 32 is disposed in the air space. There is no mention of gas being used.

Gaugler et al is of interest in that it discloses the use of a plastic bag made of a laminate and containing an insulation material therein. The bag is filled with a gas. The thermal conductivity of various gases and how $CO_2$ compares with air and other gases is indicated in FIG. 5.

Dybvig is of interest in that it discloses the use of an insulated bag made of heat sealable material and including two compartments 18, 19. Compartment 18 is filled with insulation material such as fiberglass and charged with Freon gas. Compartment 19 is filled only with a solid porous material such as sponge rubber.

Dillon is of interest in that it discloses the use of a plastic bag, hermetically sealed, and filled with a batt of heat insulating material (example: glass fibers). The interior of the bag is charged with a mixture of carbon dioxide and $CCl_2F_2$ at atmospheric pressure. The gas mixture has a lower thermal conductivity than that of air.

Simms et al is of interest in that it discloses the use of a hermetically sealed bag, constructed of a multi-ply laminate having high tear strength and high abrasion resistance. The bag contains a porous mass of insulating material and a charge of gas having low thermal conductivity (Freon).

Stickel is of interest in that it discloses an insulated bag containing a slab of glass fibers or mineral wool. The interior of the bag is evacuated and then filled with a gas having a low coefficient of heat transmission such as a Freon or sulphur dioxide.

Franklin is of interest in that it discloses a fiber-glass batt having side edges adapted for securement to studs.

The side edges have an adhesive material (covered by a protective strip) for placement against the studs.

Adorjan is of interest in that it discloses a double wall, hermetically sealed structure 10, 12 having a cavity therein. The cavity is evacuated and filled with a foam blown in along with a Freon gas.

The prior art patents discussed above, although relevant to the extent that they relate to various insulation structures and the uses thereof, are not seen to be a barrier to patentability of the invention disclosed and claimed herein.

SUMMARY OF THE INVENTION

The present invention relates to a new and improved insulation structure and the method of applying same to use in building wall, ceiling, or like member to provide a new and improved heat transfer barrier in order to reduce the consumption of energy, whether it be to heat the interior of the building in the cold seasons or to cool the same in the hot seasons. Upon reading the present specification, the reader will readily appreciate that it is an object of this invention to provide a new and improved heat insulation structure which will be easy to install.

Another object of this invention is to provide a new and improved insulation module which is easy to store, easy to transport, and may be delivered in ready to use condition.

A further object of this invention is to provide a new and improved insulation package which is preassembled for standard size so that little or no trimming is required prior to installation.

Yet another object of this invention is to provide a new and improved insulation module which may be expected to furnish a greater degree of resistance to heat transfer for the volume of material required.

Moreover, it is an object of this invention to provide a new and improved insulation module, which because it may be deflated prior to use, will be handled with relative ease.

Other objects and advantages of the present invention will be readily discernible to the reader upon closer examination of the following description taken in conjunction with the accompanying drawings.

BRIEF DESCRIPTION OF THE DRAWINGS

Referring briefly to the drawings, the reader will readily visualize the preferred embodiment of the present invention wherein.

DETAILED DESCRIPTION OF THE INVENTION

Figure 1:
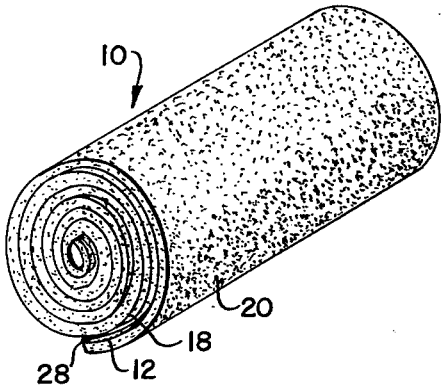
FIG. 1 is a view in perspective of an insulation module according to the present invention in rolled condition for storage or shipment prior to use.

Referring now to the drawings with greater particularity, the reader will readily see in FIGS. 1–5 that the new and improved insulation structure according to the present invention comprises a module 10 which may be stored or shipped in rolled condition prior to being put in use as illustrated in FIG. 1. In preparation of the module insulation structure 10 for installation, one needs only to unroll it from the stored or shipped condition of FIG. 1 to the spread-out condition illustrated in FIG. 2. Insulation structure 10 according to the present invention comprises an inflatable envelope 12 of gas imperious elastomeric material, wherein the envelope 12 includes two main wall portions 14, 16 with first heat transfer barrier member 18 and second heat transfer barrier member 20, discrete and separate from each other, but secured to and substantially fully covering main wall portions 14 and 16 externally of inflatable envelope 12. Heat barrier members 18 and 20 may each comprise a layer of fiberglass, mineral wool or other equivalent thermal insulation material known in the industry. Heat barrier members may be taped, stitched, stapled or secured to wall portions 14, 16 in any other practical way as long as such stitching, stapling or like manner of securing is achieved without puncturing the wall portions 14, 16.

A perforated sheet member 22 having substantially the same overall dimensions as that of the two main wall portions 14, 16 is disposed within envelope 12 to act as separating means between main wall portions 14, 16 so that when the insulation structure or module 10 is in rolled condition for storage or shipping wall portions 14, 16 will not adhere to each other, particularly where envelope 12 is of such plastic material which may tend to fuse or adhere under certain storage conditions. In carrying forth the present invention, it is conceived that the separating sheet member 22 be a sheet of Kraft paper, for example, and is suspended between the two main wall portions 14, 16. Sheet member 22 may be suspended between wall portions 14, 16, for example, by being stitched to envelope 12 at the edges and/or corners thereof. Thus, it can be readily appreciated with the presence of separating sheet member 22 within envelope 12 as described, wall portions 14, 16 will not adhere to each other in any event. To facilitate flow of gas to properly inflate envelope 12, sheet member 22 is formed with a plurality of perforations 26.

To facilitate inflation of envelope 12, one wall portion 14, for example, is provided with a one-way valve 24 which will permit introduction of an inflating gas, from a bottle or cartridge C, for example, and will normally retain the inflating medium in envelope 12. Valve 24 may be of the type commonly used in automotive tires or the like so that, if desired, envelope 12 may be deflated by positive external manipulation of valve 24.

While any gas can be used to inflate envelope 12 including air and even toxic gases, obviously, neither toxic gases nor combustible gases will be used to inflate envelope 12. Air is plentiful and functional to enhance the insulative character of insulation structure 10. Carbon dioxide, however, is the preferred inflating medium in that it is neither toxic nor combustible and at the same time provides acceptable insulative value. Carbon dioxide further provides the added advantage that in case of fire, any carbon dioxide escaping from envelope 12 will have the effect of arresting the fire in the immediate area.

From the foregoing description, it is readily apparent that in inflated condition insulation structure or module 10 will provide very substantial insulative effect from the combination of a gas filled envelope 12 in sandwich relation with and between a pair of heat transfer members 18, 20.

Figure 3:
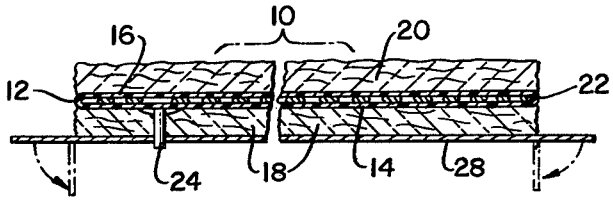
FIG. 3 is a sectional view taken along the section line 3—3 in FIG. 2.
Figure 2:
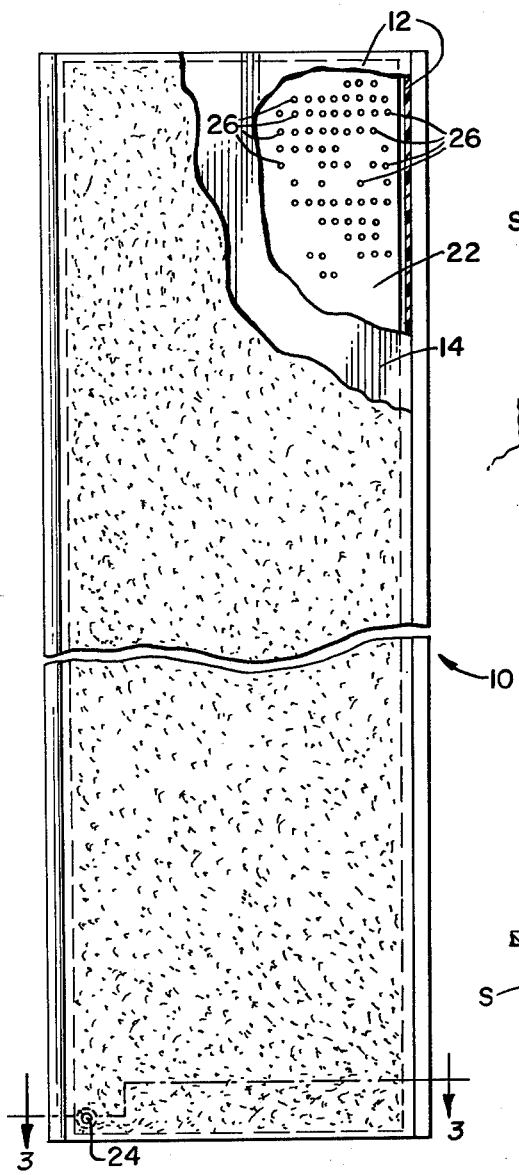
FIG. 2 is a front elevational view of the insulation module according to the present invention prior to being installed with portions broken away to show details.
Figure 4:
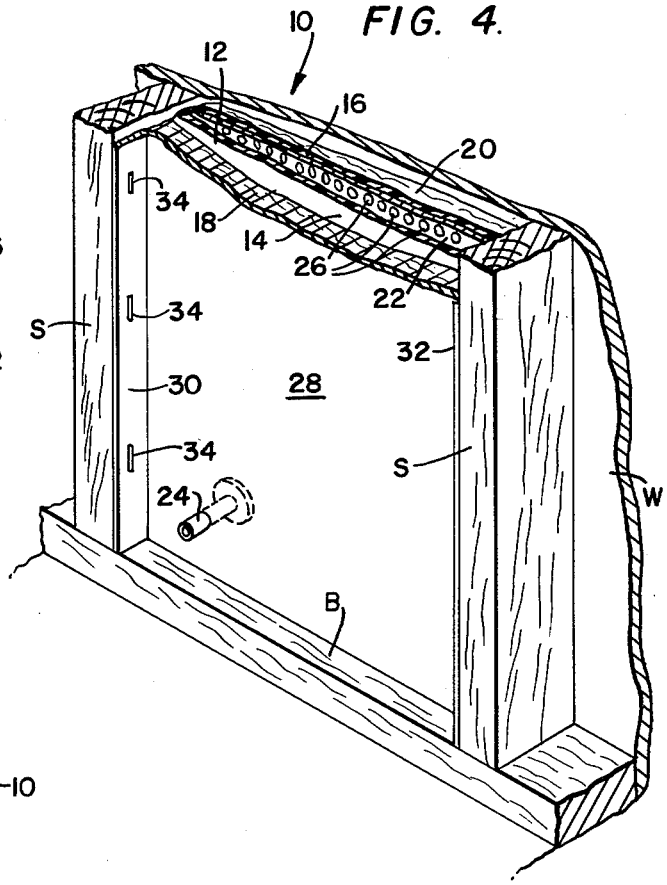
FIG. 4 is a fragmentary view in perspective of the insulation module after installation.
Figure 5:
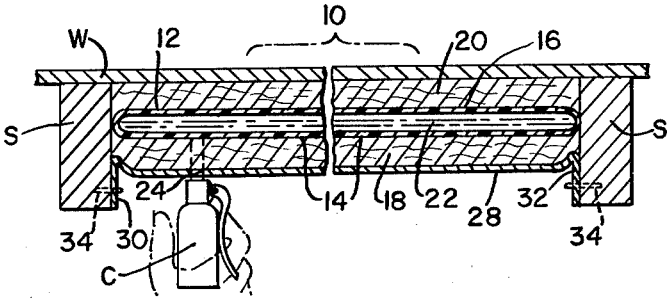
FIG. 5 is an overhead view taken through a horizontal section of the installation in FIG. 4 with portions broken away and omitted.

As a further feature of the insulation structure or module 10, a sheet 28 may be attached to one of the heat barrier members 18 to facilitate installation of the module 10 between ceiling rafters and/or wall studs S extending above beam B. Sheet member 28 may be of rollable, semi-rigid plastic material such that it can be rolled into storage or shipping condition and yet be supportive of module 10 when extended into vertical position, for example. Supporting sheet member 28 as seen in FIG. 3 includes marginal portions 30, 32 extending slightly beyond the margins of heat transfer barrier 18, for example. Marginal portions 30, 32 may have a pressure sensitive adhesive of the type that will adhere to a metal surface on one side thereof and covered thereat by a peelable plastic tape. Marginal portions 30, 32 are foldable in the direction of the arrows in FIG. 3 to be adhered or secured to a surface extending at an angle thereto, for example, as seen in FIGS. 4 and 5. In addition to or as an alternative to the use of adhesive along marginal portions 30, 32, brads, nails, staples 34 or the like may be applied thereto where the rafters and/or studs are wooden rather than metal.

A finished wall W is shown on one side of the module 10 as installed between studs S. It is clear that a second finished wall may enclose and conceal the studs S and insulation structure 10 from view as shown in FIG. 4.

Further, in carrying forth the inventive concept according to the instant application, one may effectively minimize heat transfer between opposite sides of a ceiling, wall W, or like member supported by rafters or studs S by securing an inflatable gas impervious envelope 12, having a valve member 24 therein, between and to a first layer of heat transfer barrier material 18 and a second layer of heat transfer barrier material 20 in sandwich relationship therewith; installing the assembly 10 thus formed between studs S or rafters supporting a building wall W or ceiling; and introducing a gas, such as carbon dioxide, through the valve member 24 into the envelope 12 to inflate the envelope 12 to thereby insulate a wall W or ceiling. The gas introduced into envelope 12 as indicated hereinabove may be achieved by application of a commercially available bottle or cartridge C of carbon dioxide to valve member 24. If desired, the cartridge C may be fixed on valve member 24 and supplied with module 10 as a unit, in which case the cartridge C would contain the precise amount of gas to inflate envelope 12 to the desired volume. In this way, there will be no guess work as to how much gas should be introduced into envelope 12 and also inflation can be achieved by merely activating the gas discharge mechanism of cartridge C without the step of applying cartridge C to valve member 24 since they are already assembled together.

For use in the insulation of flooring or rafters, the insulation module 10 need only be selected as to proper size, laid and unrolled for inflation.

In storage or shipping condition, the rolled insulation module 10 occupies much less space than conventional insulation material. Use of the disclosed module 10 is much simpler than use of conventional material, since no cutting is required, particularly when the user is familiar with proper size which can be selected. Thus, excessive time and waste are avoided when the concept according to the present invention is applied. Further, in case the integrity of the envelope is breached by a spark, electrical short circuit, or other fire, carbon dioxide will flow toward the breach to put our or inhibit spread of fire and arrest it in its incipiency.

It will be obvious to those skilled in the art that various changes may be made without departing from the scope of the invention and the invention is not to be considered limited to what is shown in the drawings and described in the specification.

What is claimed is:

1. Building insulation structure, which may be stored or shipped in rolled condition prior to being put in use to minimize heat transfer between opposite sides of a building wall, ceiling, or like member supported by studs or rafters along various areas thereof, said insulation structure comprising in combination:

(a) an inflatable envelope of gas impervious material wherein said inflatable envelope includes at least two main wall portions;

(b) first discrete heat transfer barrier means substantially fully covering and secured to one of said main wall portions externally of said inflatable envelope;

(c) second discrete heat transfer barrier means substantially fully covering and secured to the other of said main wall portions externally of said inflatable envelope;

(d) means for separating said two main wall portions situated within the interior of said inflatable envelope and disposed between said two main wall portions; and (e) valve means for facilitating entry of an inflating medium into said inflatable envelope and retaining an inflating medium within said inflatable envelope;

said separating means being a perforate sheet member having substantially the same overall dimensions as that of said two main wall portions separated thereby so that said insulation structure may be rolled into storage or shipping condition without adhesion of said two main wall portions to each other.

2. The insulation structure as defined in claim 1 wherein said perforate sheet member is of kraft paper.

3. The insulation structure as defined in claim 2 wherein said first heat transfer barrier and said second heat transfer barrier each comprises a layer of fiberglass.

4. The insulation structure as defined in claim 2 wherein said first heat transfer barrier and said second heat transfer barrier each comprises a layer of mineral wool.

5. The insulation structure as defined in claim 2 wherein said inflatable envelope is inflated with carbon dioxide gas.

6. The insulation structure as defined in claim 2 wherein said first heat transfer barrier means is attached to a semi-rigid support sheet, and said support sheet includes marginal portions having means applied thereto for securing said structure in place between studs, rafters, or the like of a building.

7. The insulation structure as defined in claim 2 wherein a cartridge is connected to said valve means and assembled in combination with said insulation structure, said cartridge containing the precise amount of gas to inflate said envelope to the desired volume and including a gas discharge mechanism which upon activation will permit gas to flow from said cartridge through said valve means into said envelope.

8. A building comprising in combination a pair of spaced-apart beams and at least one beam defining a space filled with insulation structure which may be stored or shipped in rolled condition prior to being put in use to minimize heat transfer between opposite sides of a building wall, ceiling, or like member supported by studs or rafters along various areas thereof, said insulation structure being secured to said studs and said beam to form part of a wall, said insulation structure including:

(a) an inflatable envelope of gas impervious material wherein said inflatable envelope includes at least two main wall portions;

(b) means for separating said two main wall portions situated within the interior of said inflatable envelope and disposed between said two main wall portions; and (c) valve means for facilitating entry of an inflating medium into said inflatable envelope and retaining an inflating medium within said inflatable envelope.

9. A method of minimizing heat transfer between opposite sides of a building wall, ceiling, or like member supported by studs or rafters along various area thereof comprising the steps:

(a) securing an inflatable gas impervious envelope having a valve member therein between and to a first layer of heat transfer barrier material and a second layer of heat transfer barrier material in sandwich relationship therewith;

(b) installing the assembly formed in step (a) between studs or rafters supporting a building wall or ceiling; and (c) introducing a gas, such as carbon dioxide, through the valve member into the envelope to inflate the envelope to thereby insulate a wall or ceiling.

10. The method as defined in claim 9 wherein gas is introduced into the envelope in step (c) by application of a commercially available carbon dioxide cartridge or bottle to the valve member.

* * * * *